US007146955B2

(12) United States Patent
Sailer et al.

(10) Patent No.: US 7,146,955 B2
(45) Date of Patent: Dec. 12, 2006

(54) HYDRAULIC TAPPET CLEARANCE COMPENSATION DEVICE

(75) Inventors: Peter Sailer, Erlangen (DE); Oliver Schnell, Veitsbronn (DE)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/382,287

(22) Filed: May 9, 2006

(65) Prior Publication Data

US 2006/0254549 A1 Nov. 16, 2006

(30) Foreign Application Priority Data

May 10, 2005 (DE) ..... 10 2005 021 392

(51) Int. Cl.
*F01L 1/14* (2006.01)

(52) U.S. Cl. ..... 123/90.52; 123/90.45; 123/90.55; 123/90.48

(58) Field of Classification Search ..... 123/90.35, 123/90.43, 90.45, 90.48, 90.52, 90.55, 90.56, 123/90.57
See application file for complete search history.

(56) References Cited

U.S. PATENT DOCUMENTS 6,606,972 B1 * 8/2003 Wenisch et al. ..... 123/90.17

FOREIGN PATENT DOCUMENTS

DE 41 03 055 A1 8/1992

* cited by examiner

*Primary Examiner*—Ching Chang
(74) *Attorney, Agent, or Firm*—Lucas & Mercanti, LLP

(57) ABSTRACT

The invention relates to a hydraulic tappet clearance compensation device (1) for a valve gear of an internal combustion engine, the high pressure chamber (8) of which device can be rapidly and easily vented. For this purpose an annular collar (11) has radial openings (16) distributed over the circumference of its pressure piston (5). These allow air bubbles, which accumulate between an outer shell of the annular collar (11) and a bore (3) of a housing (2), to escape to a bore (9) for a non-return valve (10) and hence directly into the open. There is therefore no need for venting via a leakage gap (13) between the pressure piston (5) and the housing (2), which has hitherto yielded only unsatisfactory results.

9 Claims, 1 Drawing Sheet

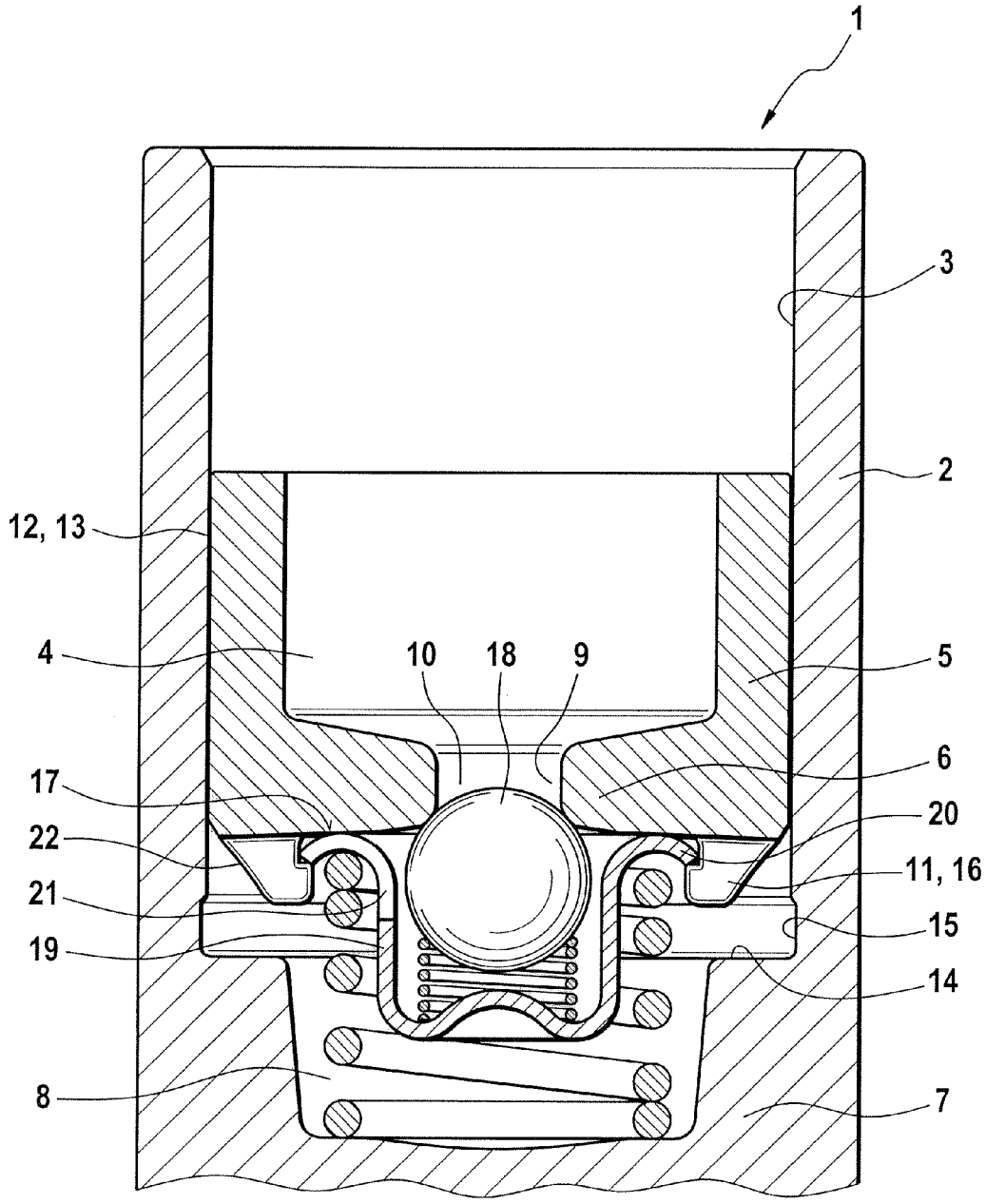
1
3
2
12, 13
4
10
18
9
5
6
17
20
22
11, 16
21
15
19
14
8
7

HYDRAULIC TAPPET CLEARANCE COMPENSATION DEVICE

This application claims priority under 35 U.S.C. § 119 to German Patent Application No. 10 2005 021 392.8, filed on May 10, 2005.

FIELD OF THE INVENTION

The invention relates to a hydraulic tappet clearance compensation device, comprising a canister-shaped housing, running in the bore of which is a hollow-cylindrical pressure piston, axially moveable in relation to said housing and enclosing a hydraulic fluid reservoir, a high pressure chamber for hydraulic fluid being formed between a bore-side piston ring land of the pressure piston and a base of the housing, the piston ring land having a central bore, which is provided on a high pressure chamber side of the piston ring land with a non-return valve opening in the direction of the high pressure chamber and radially outside which piston ring land an annular collar protrudes axially towards the high pressure chamber, a leakage gap for the hydraulic fluid from the high pressure chamber being formed between an outer shell of the pressure piston and the bore of the housing, the base of the housing forming a stop face for the annular collar of the pressure piston in the sunken position thereof and the bore of the housing running out in an annular enlargement in the section thereof adjoining the stop face.

BACKGROUND OF THE INVENTION

Such a tappet clearance compensation device proceeds from the generic DE 199 42 983 A1. This is here designed as a hydraulic support element for a rocker lever of a valve gear of an internal combustion engine. For the purposes of tappet clearance compensation its pressure piston is slightly moveable in an axial direction relative to the housing. If the internal combustion engine is switched off whilst the cam acting on the cam follower is lifting, the pressure piston subsides onto the facing end face of the housing.

Unwanted air bubbles can accumulate in the high pressure chamber of the aforementioned tappet clearance compensation device. This occurs even before the internal combustion engine is started up and during operation of the engine. The air bubbles in the high pressure chamber lead to an unwanted compressibility of the tappet clearance compensation device, with the disadvantages sufficiently familiar to the person skilled in the art. Any escape of the air bubbles would at best be accomplished via the leakage gap between the internal element and the housing, which is unsatisfactory, however, since this process takes too much time. It is also possible, for example, that the air bubbles will accumulate precisely in an annular space between the outer shell of the submerged internal element and the base-side annular enlargement of the housing.

In the high pressure chamber unwanted particles can moreover accumulate, as need not be further explained to the person skilled in the art. These exist, for example, due to original contamination during the production process, or to particles such as abrasion entrained by the hydraulic fluid. These particles adhere to the outer shell of the pressure piston and can get into the leakage gap in the next tappet clearance compensation sequence, in which the pressure piston performs an axial movement out of the housing bore. This can lead to a jamming of the pressure piston in the bore of the housing, with the result that a tappet clearance compensation function of the tappet clearance compensation device fails or the valve lift can no longer be performed correctly. The tendency of unwanted particles to accumulate is further encouraged in that on the outer shell of the sunken pressure piston there is relatively little space available in a radial direction towards the annular enlargement (recess).

Attempts have been made to solve the problem of original contamination outlined above through costly flushing measures. Preventing unwanted particles from getting into the high pressure chamber by means of separators such as strainers, magnets etc. installed directly upstream of the actual tappet clearance compensation device is also known.

OBJECT OF THE INVENTION

The object of the invention is therefore to create a tappet clearance compensation device of the aforementioned type, in which the disadvantages cited are eliminated.

SUMMARY OF THE INVENTION

According to the invention this object is achieved in that the annular collar has a radial opening or multiple radial openings distributed over the circumference, a development of the invention in which the annular collar furthermore tapers conically on its outer side being particularly advantageous.

The disadvantages cited in the introductory part are therefore effectively eliminated. Air bubbles which accumulate in the leakage gap area below the pressure piston readily migrate via the radial opening(s) towards the closing member (preferably a ball, although a disc valve or the like is also feasible) of the non-return valve. If a high pressure chamber side of the piston ring land of the pressure piston is represented as conically tapering, moreover, this desirable escape of air bubbles towards the non-return valve is greatly assisted.

When a tappet clearance compensation occurs during a cam base circle phase with the ball of the non-return valve opening, the unwanted air bubbles escape faster towards the reservoir and directly into the open. This therefore provides a high pressure chamber of a hydraulic tappet clearance compensation device, which can be easily and rapidly vented.

If the annular collar of the pressure piston, which protrudes axially towards the high pressure chamber and affords the sunken pressure piston support on a stop face of the housing, is moreover represented as tapering conically on the outside thereof, the unwanted particles, such as abrasion, original contamination etc, can no longer adhere to the outer shell of the pressure piston and possibly be drawn into the leakage gap under an axially upward movement of the pressure piston.

It is particularly advantageous if, in a development of the invention, the conically tapering annular collar is at least as high or advantageously higher than the annular enlargement at the base of the housing. The cylindrical outer shell of the pressure piston therefore no longer has any contact with the unwanted particles. At the same time the relatively "raised" chamfer means a greater volume for hydraulic fluid. This inevitably results in more available space for the unwanted particles, without any adhesion occurring to the outer shell of the pressure piston. The chamfer may have an angle in the range of 30°±150 in relation to the outer shell of the pressure piston.

A further dependent claim relates to a suitable development of the radial openings. These should preferably (but not necessarily) be uniformly distributed over the circumference and should give the annular collar a crown-like geometry. It is left to the person skilled in the art to choose other shapes for the radial openings such as rectangular, semi-circular or circular, triangular etc. A good depth of the radial openings is important for an efficient escape of the air bubbles, accumulating radially outwards, towards the bore in the piston ring land.

Tests have revealed, for example, that four radial openings distributed uniformly over the circumference can be advantageous. It is important that, despite any radial openings, the spring cap of the non-return valve should be securely retained on the high pressure chamber side of the piston ring land.

The aforementioned conical taper of the annular collar moreover has the advantage that when assembling it provides the pressure piston with an aid for "threading" into the housing bore.

It is also advantageous to manufacture at least one of the components, the pressure piston and/or the housing, by a chipless process such as extrusion. This has a positive impact on the production costs.

According to another development of the invention the tappet clearance compensation device is to be built or designed so that it can be incorporated into a cam follower of a valve gear on an internal combustion engine or formed as an integral part of such a cam follower. Possible cam followers (adjustable, non-adjustable) include roller or bucket tappets, rocker levers, rocker arms or follower arms. Support elements for follower arms are also feasible.

It is likewise proposed to fit the tappet clearance compensation device according to the invention into a belt or chain tensioning device, such as a primary or secondary drive of an internal combustion engine. In general terms, however, an application of the tappet clearance compensation device according to the invention is feasible wherever there is a need to compensate for play resulting from heat and/or wear.

BRIEF DESCRIPTION OF THE DRAWING

The invention is appropriately explained in more detail with reference to the drawing. The single FIGURE shows a longitudinal section through a tappet clearance compensation device according to the invention.

DETAILED DESCRIPTION OF THE INVENTION

FIG. 1 discloses a hydraulic tappet clearance compensation device 1 for a valve gear of an internal combustion engine. The tappet clearance compensation device 1 comprises a canister-shaped housing 2, in the bore 3 of which a pressure piston 5, axially moveable in relation to said housing, is fitted. At one side the housing 2 has a base 7 with a stop face 14 (ring face) for the pressure piston 5 when this is in the sunken position.

The pressure piston 5 concentrically encloses a hydraulic fluid reservoir 4. At the same time the pressure piston 5 is provided at the base 7 side with a piston ring land 6. The latter has a central bore 9 allowing hydraulic fluid to pass from the reservoir 4 into an underlying high pressure chamber 8, and vice-versa. A high pressure chamber side 17 of the piston ring land 6 is shown tapering like a funnel towards the bore 9.

An annular collar 11 protrudes radially outside the high pressure chamber side 17 towards the high pressure chamber 8. Said collar is designed so that it tapers conically on its outside 22. In addition the annular collar 11 has, for example, four radial openings 16 distributed over the circumference, so that it has a crown-like geometry.

As can be seen, the bore 3 of the housing 2, in the area of the stop face 14, runs out in an annular enlargement 15, which may be done for technical production reasons. The person skilled in the art will further appreciate from the FIGURE that the annular collar 11 is of a greater height than the annular enlargement 15.

A non-return valve 10 is shown on the high pressure chamber side 17 of the piston ring land 6. This valve here comprises a ball 18, which is permitted a slight axial travel inside a spring cap 19. It is also shown how the ball 18 is spring-loaded towards its seat on the bore 9. However, non-return valves in which spring-loading is dispensed with or in which the ball 18 is sprung in the direction of the high pressure chamber 8, are also feasible and are provided for.

The spring cap 19 has at least one radial passage 21 for hydraulic fluid and air. It is securely fixed, for example by clamping, by its edge 20 to the high pressure chamber side 17.

As described in the introductory part of the description, air bubbles can accumulate in the high pressure chamber 8. This leads to an unwanted pliability of the tappet clearance compensation device 1 during a cam lifting phase. Although an escape of these air bubbles via a leakage gap 13 between the bore 3 and the housing 2 and the outer shell 12 of the pressure piston 5 is both possible and intended, this gives only unsatisfactory results. Should air bubbles accumulate in an annular space between the conical annular collar 11 and the bore 3 of the housing 2 therefore, according to the measures provided by the invention these air bubbles can now easily migrate via the radial openings 16 in the annular collar 11 towards the ball 18 of the non-return valve 10. When the ball 18 next lifts off from the seat (cam base circle phase) these air bubbles escape faster via the bore 9 of the piston ring land 6 towards the reservoir 4 and then directly into the open.

A tappet clearance compensation device 1 is therefore provided, the high pressure chamber 8 of which can be vented more rapidly. The conically tapering annular collar 11 with its height suitably exceeding the height of the annular enlargement 15, moreover has the advantage, as described above, that it prevents dirt, chips etc. being draw into the leakage gap 13.

The invention claimed is:

1. A hydraulic tappet clearance compensation device (1), comprising a canister-shaped housing (2), running in the bore (3) of which is a hollow-cylindrical pressure piston (5), axially moveable in relation to said housing and enclosing a hydraulic fluid reservoir (4), a high pressure chamber (8) for hydraulic fluid being formed between a bore-side piston ring land (6) of the pressure piston (5) and a base (7) of the housing (2), the piston ring land (6) having a central bore (9), which is provided on a high pressure chamber side (17) of the piston ring land (6) with a non-return valve (10) opening in the direction of the high pressure chamber (8) and radially outside which piston ring land (6) an annular collar (11) protrudes axially towards the high pressure chamber (8), a leakage gap (13) for the hydraulic fluid from the high pressure chamber (8) being formed between an outer shell (12) of the pressure piston (5) and the bore (3) of the housing (2), the base (7) of the housing (2) forming a stop face (14) for the annular collar (11) of the pressure piston (5) in the sunken position thereof and the bore (3) of the housing (2) running out in an annular enlargement (15) in the section thereof adjoining the stop face (14), wherein that the annular collar (11) has a radial opening (16) or multiple radial openings (16) distributed over the circumference; wherein that the annular collar tapers conically on the outside (22) thereof.

2. The tappet clearance compensation device according to claim 1, wherein that the radial opening (16) or at least one of the radial openings (16) has a depth such that it at least reaches to the piston ring land (6).

3. The tappet clearance compensation device according to claim 1, wherein that the annular collar (11) has a crown-like geometry with radial openings (16) uniformly distributed over the circumference.

4. The tappet clearance compensation device according to claim 1, wherein that in its tapering section the annular collar (11) is as high or higher than the annular enlargement (15).

5. The tappet clearance compensation device according to claim 1, wherein that on its high pressure side (17) the piston ring land (6) tapers like a funnel to the bore (9).

6. The tappet clearance compensation device according to claim 1, wherein that the non-return valve (10) is represented in the form of a ball valve, the ball (18) in the direction remote from the bore encountering a travel limit stop on a hat-like spring cap (19), the limit stop bearing with its edge (20) on the high pressure chamber side (17) of the piston ring land (6) and having at least one radial passage (21) for the hydraulic fluid.

7. The tappet clearance compensation device according to claim 1, wherein that at least one of the elements, the pressure piston (5) with annular collar (11) and/or the housing (2), is formed in one piece by a chipless extrusion process.

8. The tappet clearance compensation device according to claim 1 wherein that the tappet clearance compensation device (1) is incorporated into a cam follower or into a supporting element for this in a valve gear of an internal combustion engine, or is an integral part thereof.

9. The tappet clearance compensation device according to claim 1 wherein that the tappet clearance compensation device (1) is incorporated into a tensioning device for a belt or chain, or is an integral part thereof.

* * * * *